United States Patent [19]

Terauchi

[11] Patent Number: 4,627,799

[45] Date of Patent: Dec. 9, 1986

[54] AXIAL SEALING MECHANISM FOR A SCROLL TYPE FLUID DISPLACEMENT APPARATUS

[75] Inventor: Kiyoshi Terauchi, Isesaki, Japan

[73] Assignee: Sanden Corporation, Japan

[21] Appl. No.: 843,929

[22] Filed: Mar. 24, 1986

Related U.S. Application Data

[63] Continuation of Ser. No. 644,378, Aug. 27, 1984, abandoned.

[51] Int. Cl.[4] ..... F01C 1/04; F01C 19/08

[52] U.S. Cl. ..... 418/55; 418/142; 277/177; 277/204

[58] Field of Search ..... 418/55, 57, 142; 277/81 P, 177, 204

[56] References Cited

U.S. PATENT DOCUMENTS

| | | | |
|---|---|---|---|
| 801,182 | 10/1905 | Creux . | |
| 1,296,618 | 3/1919 | Brown . | |
| 2,807,511 | 9/1957 | Fleming . | |
| 2,887,331 | 5/1959 | Johnson . | |
| 3,059,584 | 10/1962 | Cottell . | |
| 3,195,470 | 7/1965 | Smith . | |
| 3,986,799 | 10/1976 | McCullough . | |
| 3,994,633 | 11/1976 | Shaffer . | |
| 3,994,635 | 11/1976 | McCullough . | |
| 3,994,636 | 11/1976 | McCullough et al. | 418/55 |
| 4,065,279 | 12/1977 | McCullough . | |
| 4,199,308 | 4/1980 | McCullough . | |
| 4,212,472 | 7/1980 | Mizuno et al. . | |
| 4,221,390 | 9/1980 | Bainbridge . | |
| 4,309,039 | 1/1982 | Irick . | |
| 4,345,886 | 8/1982 | Nakayama et al. . | |
| 4,395,205 | 7/1983 | McCullough . | |
| 4,416,597 | 11/1983 | Eber et al. . | |
| 4,453,899 | 6/1984 | Hiraga et al. . | |
| 4,462,771 | 7/1984 | Teegarden . | |

FOREIGN PATENT DOCUMENTS

| | | | |
|---|---|---|---|
| 65261 | 11/1982 | European Pat. Off. | 418/55 |
| 1218822 | 6/1966 | Fed. Rep. of Germany . | |
| 2319789 | 11/1973 | Fed. Rep. of Germany | 277/177 |
| 2402558 | 12/1973 | Fed. Rep. of Germany . | |
| 1395747 | 3/1965 | France | 418/142 |

*Primary Examiner*—John J. Vrablik

*Attorney, Agent, or Firm*—Banner, Birch, McKie & Beckett

[57] ABSTRACT

A scroll type fluid displacement apparatus is disclosed in which a pair of scrolls interfit at an angular and radial offset, each scroll including a circular end plate and a spiral element. The axial end surface of each spiral element has a groove along its spiral curve and a seal element is fitted in the groove to seal off fluid pockets. A plurality of projections are formed in the bottom surface of the groove at a predetermined spacing. Then, when the scrolls are assembled in their interfitting positions, the seal element is partly compressed and deformed by the projections and the opposing circular end plate so that the seal element maintains contact with the facing end plate of the opposing scroll without the use of any axial force urging device.

1 Claim, 8 Drawing Figures

AXIAL SEALING MECHANISM FOR A SCROLL TYPE FLUID DISPLACEMENT APPARATUS

This application is a continuation of application Ser. No. 644,378, filed Aug. 27, 1984, now abandoned.

BACKGROUND OF THE INVENTION

This invention relates to a fluid displacement apparatus, and more particularly, to an axial sealing mechanism for a scroll type fluid displacement apparatus.

Scroll type fluid displacement apparatus are well known in the prior art. For example, U.S. Pat. No. 801,182 issued to Creux discloses apparatus including two scroll members each having a circular end plate and a spiroidal or involute spiral element. These scroll members are maintained angularly and radially offset so that both spiral elements interfit to make a plurality of line contacts between their spiral curved surfaces to thereby seal off and define at least one pair of fluid pockets. The relative orbital motion of the two scroll members shifts the line contacts long the spiral curved surfaces and, therefore, the fluid pockets change in volume. Since the volume of the fluid pockets increases or decreases dependent on the direction of the orbiting motion, this scroll type fluid displacement apparatus is applicable to compress, expand or pump fluids.

In comparison with conventional compressors of the piston type, a scroll type compressor has certain advantages, such as fewer parts and continuous compression of fluid. However, one of the problems encountered in prior art scroll type compressors has been ineffective sealing of the fluid pockets. Axial and radial sealing of the fluid pockets must be maintained in a scroll type compressor in order to achieve efficient operation. The fluid pockets in a scroll type compressor are defined by line contacts between the interfitting spiral elements and axial contacts between the axial end surfaces of the spiral elements and the inner surface of the end plates.

One solution to the axial sealing problem is described in copending application Ser. No. 588,563, filed on Mar. 12, 1984. In the scroll type apparatus of this prior application, as shown in FIGS. 1 and 2, the end surface of each spiral element 1 which faces end plate 2 of the other scroll member is provided with groove 3 formed along the spiral. Seal element 4 is closely fitted within groove 3. Seal element 4 has an axial dimension greater than the depth of groove 3 so that, before spiral element 1 is placed in an interfitting position with another spiral element, seal element 4 projects from spiral element 1 by predetermined amount "y". Since predetermined amount "y" is greater than axial gap "t" between the axial end surface of spiral element 1 and end plate 2' of the other scroll member, when both spiral elements 1 are placed in their interfitting positions as shown in partial cross-section in FIG. 2, seal element 4 maintains contact with the facing end plate 2' of the opposing scroll member without the use of any axial force urging device.

A disadvantage of the above construction is that seal element 4 should be urged toward the facing scroll member by a greater force to accomplish effective sealing. In the above construction of the axial sealing mechanism, the seal element should be deformed by compression of the facing end plate to absorb the cumulative error of assembly of the scroll members and to accomplish effective axial sealing along the length of the seal element. As a result, the seal element in this prior construction must be formed of very soft material to enable the deformation of the seal element in accordance with the change of axial gap "t" between the spiral element and the facing end plate.

SUMMARY OF THE INVENTION

It is a primary object of this invention to provide an improved scroll type fluid displacement apparatus with high volumetric efficiency and a high energy efficiency ratio.

It is another object of this invention to provide a scroll type fluid displacement apparatus wherein abnormal wear of the axial seal element is prevented to achieve long life and axial sealing of the fluid pocket is enhanced along the length of the seal element.

It is still another object of this invention to provide a scroll type fluid displacement apparatus which is simple in construction and simple to manufacture, while achieving the above objects.

A scroll type fluid displacement apparatus according to this invention includes a pair of scrolls each comprising a circular end plate and a spiral wrap extending from one side of the circular end plate. A groove is formed in the axial end surface of each spiral wrap and extends along the spiral curve of the wrap. Plural projections are formed in the bottom surface of the groove at a predetermined spacing. A reslilient seal element is fitted in the groove having a thickness greater than the depth of the groove minus the height of each projection.

Further objects, features and other aspects of this invention will be understood from the detailed description of the preferred embodiment of this invention referring to the annexed drawings.

DETAILED DESCRIPTION OF THE PREFERRED EMBODIMENTS

Figure 1:
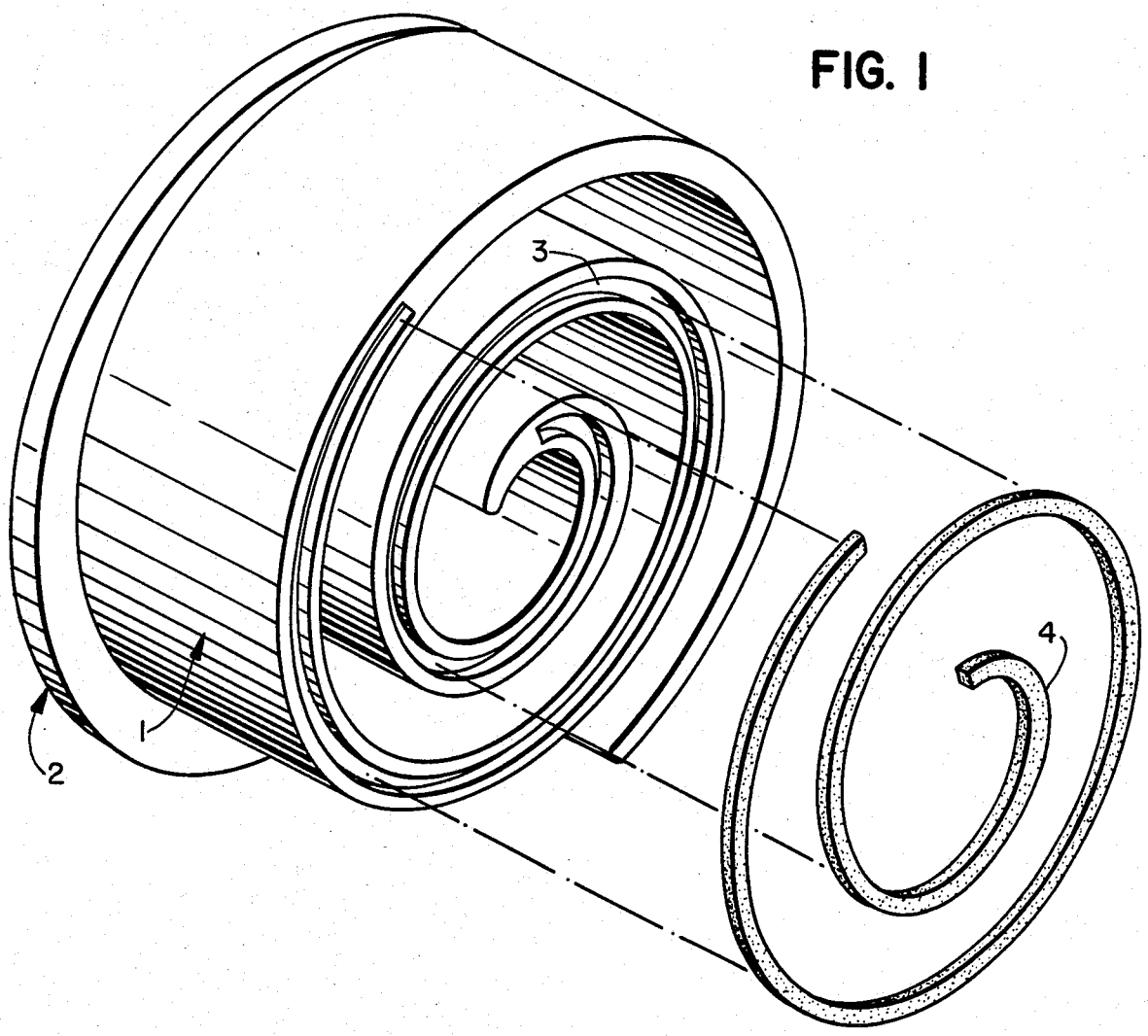
FIG. 1 is a perspective view of a known scroll member and seal element.
Figure 2A:
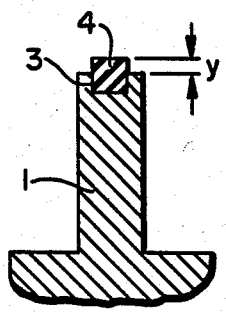
FIG. 2(*a*) is a cross-sectional view of a portion of a scroll member illustrating placement of the seal element in an axial end portion of the spiral element and FIG. 2(*b*) is a cross-sectional view of a portion of both interfitting scroll members.
Figure 2B:
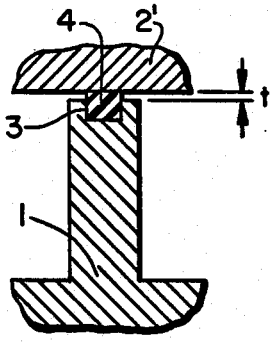
Figure 3:
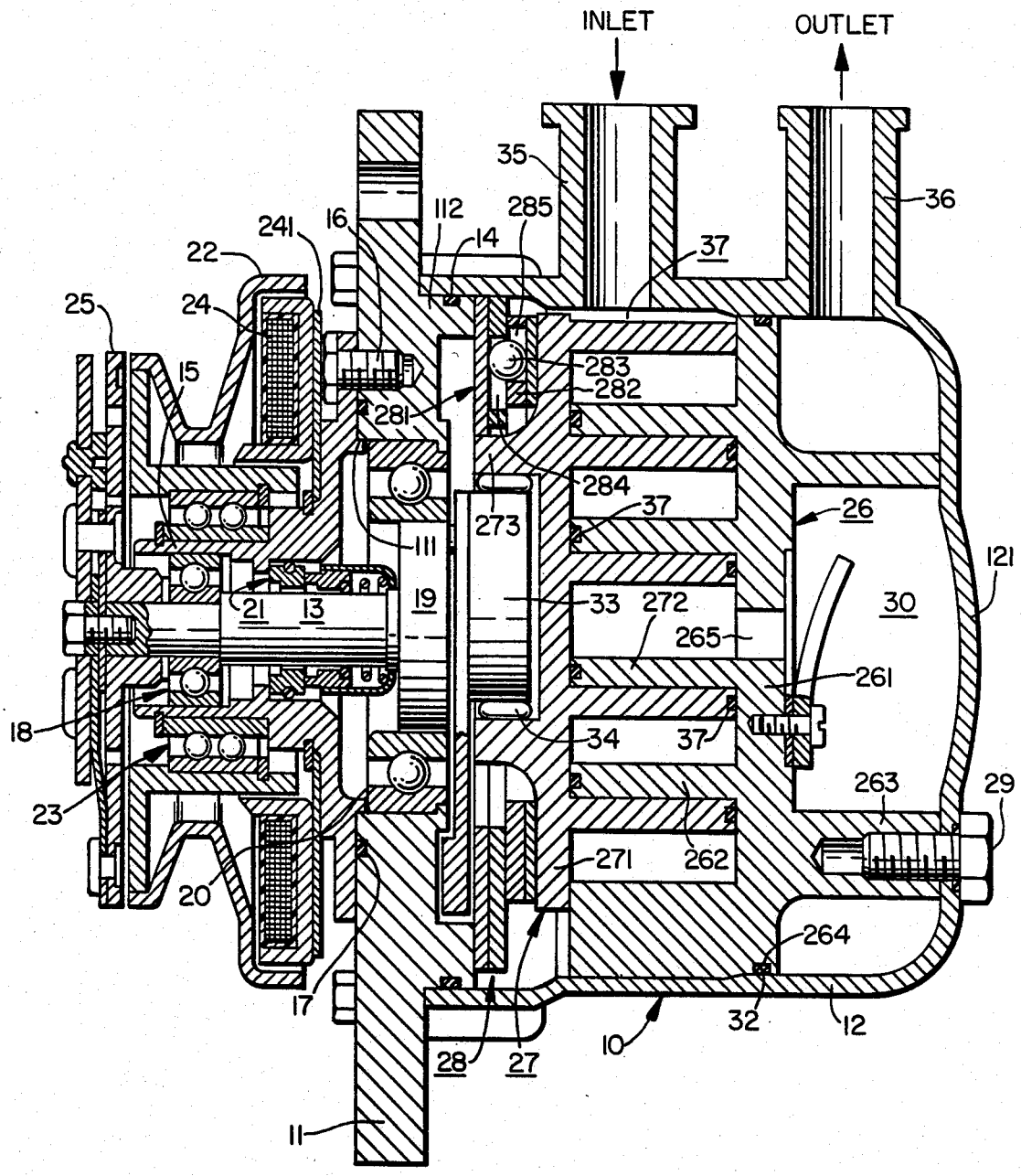
FIG. 3 is a vertical sectional view of a compressor type fluid displacement apparatus according to one embodiment of this invention.

Referring to FIG. 3, a fluid displacement apparatus in accordance with the present invention is shown which consists of a scroll type refrigerant compressor. The compressor includes compressor housing 10 having front end plate 11 and cup shaped casing 12 fastened to an end surface of front end plate 11. An opening 111 is formed in the center of front end plate 11 for supporting drive shaft 13. An annular projection 112, concentric with opening 111, is formed on the rear end surface of front end plate 11 facing cup shaped casing 12. An outer peripheral surface of annular projection 112 bites into an inner wall of the opening of cup shaped casing 12. Cup shaped casing 12 is fixed on the rear end surface of front end plate 11 by a fastening device, such as bolts and nuts, so that the opening of cup shaped casing 12 is covered by front end plate 11. An O-ring 14 is placed between the outer peripheral surface of annular projection 112 and the inner wall of cup shaped casing 12. Front end plate 11 has annular sleeve 15 projecting from the front end surface thereof; this sleeve 15 surrounds drive shaft 13 to define a shaft seal cavity. As shown in FIG. 3, sleeve 15 is attached to the front end plate 11 by screws 16, one of which is shown in FIG. 3. An O-ring 17 is placed between the front end surface of front end plate 11 and an end surface of sleeve 15 to seal the mating surface of front end plate 11 and sleeve 15. Alternatively, sleeve 15 may be formed integral with front end plate 11.

Drive shaft 13 is rotatably supported by sleeve 15 through bearing 18 disposed within the front end of sleeve 15. Drive shaft 13 has disk shaped rotor 19 at its inner end; disk shaped rotor 19 is rotatably supported by front end plate 11 through bearing 20 disposed within opening 111 of front end plate 11. A shaft seal assembly 21 is assembled on drive shaft 13 within the shaft seal cavity of sleeve 15.

A pulley 22 is rotatably supported by bearing 23 on the outer surface of sleeve 15. An electromagnetic coil 24, which is received in an annular cavity of pulley 22, is mounted on the outer surface of sleeve 15 by supported plate 241. An armature plate 25 is elastically supported on the outer end of drive shaft 13 which extends from sleeve 15. A magnetic clutch is formed by pulley 22, magnetic coil 24 and armature plate 25. Thus, drive shaft 13 is driven by an external power source, for example, an engine of a vehicle, through a rotation transmitting device, such as the above described magnetic clutch.

A number of elements are located within the inner chamber of cup shaped casing 12 including fixed scroll 26, orbiting scroll 27, a driving mechanism for orbiting scroll 27, and rotation preventing/thrust bearing device 28 for orbiting scroll 27. The inner chamber of cup shaped casing 12 is formed between the inner wall of cup shaped casing 12 and front end plate 11.

Fixed scroll 26 includes circular end plate 261, wrap or spiral element 262 affixed to or extending from one end surface of circular end plate 261, and a plurality of internal bosses 263 axially projecting from the end surface of circular end plate 261 on the side opposite spiral element 262. The end surface of each boss 263 is seated on the inner surface of end plate portion 121 of cup shaped casing 12 and is fixed to end plate portion 121 by a plurality of bolts 29, one of which is shown in FIG. 3. Hence, fixed scroll 26 is fixedly disposed within cup shaped casing 12. Circular end plate 261 of fixed scroll 26 partitions the inner chamber of cup shaped casing 12 into rear chamber 30 having bosses 263, and front chamber 31, in which spiral element 262 of fixed scroll 26 is located. A sealing member 32 is disposed within circumferential groove 264 of circular end plate 261 for sealing the outer peripheral surface of circular end plate 261 and the inner wall of cup shaped casing 12. A hole or discharge port 265 is formed through circular end plate 261 at a position near the center of spiral element 262; discharge port 265 connects the fluid pockets at the center of spiral element 262 and rear chamber 30.

Orbiting scroll 27, which is disposed in front chamber 31, includes circular end plate 271 and wrap or spiral element 272 affixed to or extending from one end surface of circular end plate 262. The spiral elements 262 and 272 interfit at an angular offset of 180° and a predetermined radial offset. The spiral elements define at least a pair of fluid pockets between their interfitting surfaces. Orbiting scroll 27 is connected to the driving mechanism and rotation preventing/thrust bearing device 28. The driving mechanism and rotation preventing/thrust bearing device 28 effect orbital motion of orbiting scroll 27 by the rotation of drive shaft 13 to thereby compress fluid passing through the compressor.

Rotation preventing/thrust bearing device 28 is placed between the inner end surface of front end plate 11 and the end surface of circular end plate 271 which faces the inner end surface of front end plate 11, as shown in FIG. 3. Rotation preventing/thrust bearing device 28 includes fixed ring 281, which is fastened against the axial end surface of annular projection 112, orbiting ring 282, which is fastened against the end surface of circular end plate 272 by a fastening device, and a bearing element, such as a plurality of spherical balls 283. Rings 281 and 282 have a plurality of indentations 284 and 285 and one of the spherical balls 283 is retained between each of these indentations 284 and 285. Therefore, the rotation of orbiting scroll 27 is prevented by balls 283, which interact with the edges of indentations 284 and 285 to prevent rotation. Also, these balls 283 carry the axial thrust load from orbiting scroll 27. Therefore, orbiting scroll 27 orbits while maintaining its angular orientation to fixed scroll 26.

As orbiting scroll 27 orbits, the line contacts between spiral elements 262 and 272 shift toward the center of the spiral elements along the surfaces of the spiral elements. The fluid pockets defined by the line contacts between spiral elements 262 and 272 move toward the center with a consequent reduction of volume to thereby compress the fluid in the fluid pockets. Therefore, fluid or refrigerant gas introduced into front chamber 31 from an external fluid circuit through inlet port 35 mounted on the outside of cup shaped casing 12 is taken into the fluid pockets formed at the outer portion of spiral elements 262 and 272. As orbiting scroll 27 orbits, the fluid in the fluid pockets is compressed as the pockets move toward the center of the spiral element. Finally, the compressed fluid is discharged into rear chamber 30 through hole 265, and thereafter, the fluid is discharged to the external fluid circuit through outlet port 36 formed on cup shaped casing 12.

Figure 4:
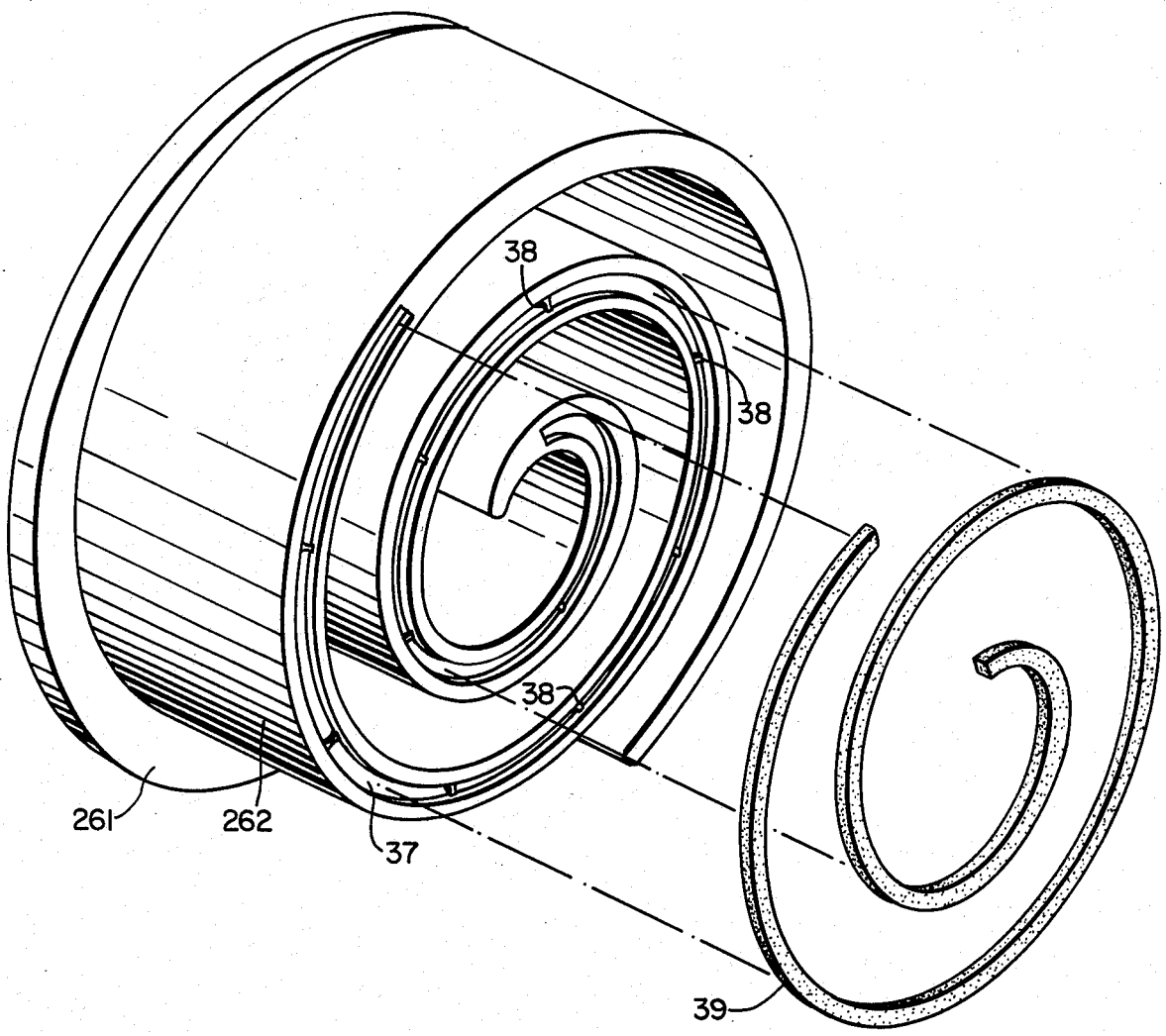
FIG. 4 is a perspective view of one scroll member of the embodiment of FIG. 3.

Referring to FIG. 4, each spiral element 262 and 272 is provided with a groove 37 formed in its axial end surface along the spiral curve of the spiral element. Groove 37 extends from the inner end portion of the spiral element to a position close to the terminal end of the spiral element.

Figure 5:
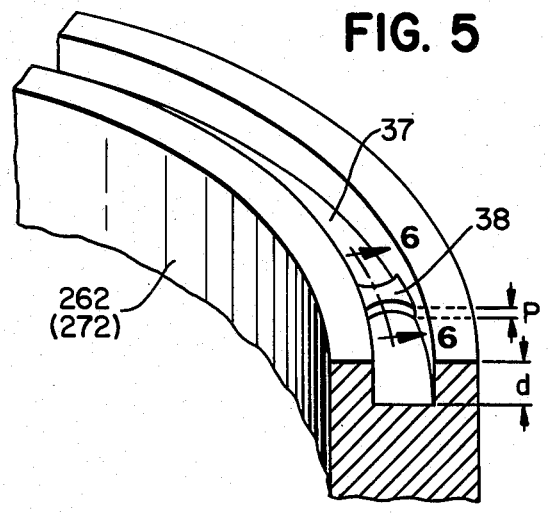
FIG. 5 is a partly enlarged perspective view illustrating one of the projections in FIG. 4.
Figure 6:
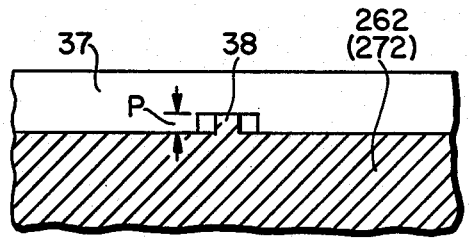
FIG. 6 is a sectional view taken along line 6—6 in FIG. 5.
Figure 7:
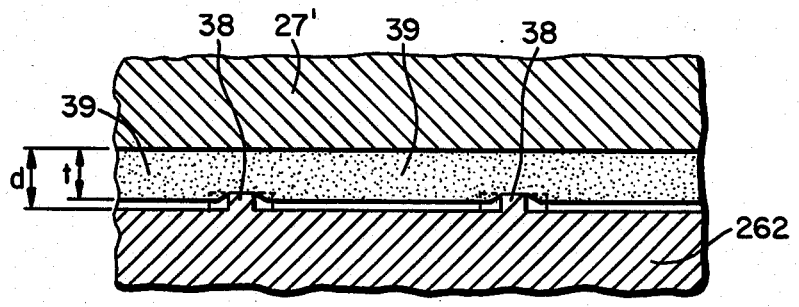
FIG. 7 is a cross-sectional view illustrating the relationship between the seal element and the facing end plate in accordance with the present invention.

As shown in FIGS. 4, 5 and 6, groove 37 is provided with a plurality of projections 38 on its bottom surface at a predetermined spacing. Groove 37 has depth "d" and each projection 38 has height "P". When resilient seal element 39 having thickness "t" greater than depth "d" of groove 37 minus height "P" of projection 38 is disposed within groove 37, part of seal element 39 corresponding to projection 38 of groove 37 extends from the upper opening of groove 37. When the scroll members with seal element 39 are assembled in their interfitting position as shown in FIG. 7, the extended portion of resilient seal element 39 is compressed by opposite end plate 271 and projections 38. The urging force for urging the seal element toward end plate 271 of the opposite scroll member is partly provided by projections 38. Therefore, the deformation of seal element 39 is easily accomplished and the gap between seal element 39 and opposite end plate 271 is effectively sealed.

This invention has been described in detail in connection with a preferred embodiment. However, this embodiment is merely for example only and the invention is not restricted thereto. It will be easily understood by those skilled in the art that other variations and modifications can be easily made within the scope of this invention, as defined by the appended claims.

I claim:

1. In a scroll type fluid displacement apparatus including a pair of scrolls each having an end plate and a spiral wrap extending from one side of said end plate, said spiral wrap having a groove formed in its axial end surface along the spiral curve, said spiral wraps interfitting at an angular and radial offset to make a plurality of line contacts which define at least one pair of fluid pockets, a driving mechanism operatively connected to one of said scrolls to orbit said one scroll relative to the other scroll while preventing rotation of said one scroll to thereby change the volume of the fluid pockets, the improvement comprising a plurality of non-resilient projections integrally formed with and immovably fixed to the bottom surface of said groove at a predetermined spacing, said projections engaging and fixed to inner and outer circumferential walls of said groove so that said projections extend completely across said groove, a resilient seal element disposed on said projections along said groove, said seal element having a thickness greater than the depth of said groove minus the depth of said projections so that said seal element partly extends from said groove to contact and be compressed by the opposing circular end plate along its entire length to thereby axially seal the fluid pockets.

* * * * *